US006758700B2

(12) United States Patent
Konno et al.

(10) Patent No.: US 6,758,700 B2
(45) Date of Patent: Jul. 6, 2004

(54) ELECTRICAL CONNECTOR

(75) Inventors: Takeshi Konno, Ibaraki (JP); Akihito Sukegawa, Ibaraki (JP); Shinichi Asano, Ibaraki (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/109,618

(22) Filed: Mar. 27, 2002

(65) Prior Publication Data

US 2002/0197894 A1 Dec. 26, 2002

(30) Foreign Application Priority Data

Mar. 27, 2001 (JP) ..... 2001-091211

(51) Int. Cl.[7] ..... H01R 13/64
(52) U.S. Cl. ..... 439/677; 439/79; 439/595
(58) Field of Search ..... 439/79, 595, 610, 439/674, 677

(56) References Cited

U.S. PATENT DOCUMENTS 3,747,047 A * 7/1973 Carter et al. ..... 439/141
4,697,864 A * 10/1987 Hayes et al. ..... 439/444
4,764,129 A * 8/1988 Jones et al. ..... 439/677
4,913,665 A * 4/1990 Sacksen ..... 439/677
5,370,556 A * 12/1994 Olsson ..... 439/681
5,503,569 A * 4/1996 Huss et al. ..... 439/595
5,890,931 A * 4/1999 Ittah et al. ..... 439/679
5,993,255 A * 11/1999 Yurko ..... 439/595

* cited by examiner

*Primary Examiner*—Michael C. Zarroli
(74) *Attorney, Agent, or Firm*—Darby & Darby

(57) ABSTRACT

An electrical connector includes a socket connector engagable with a plug connector. The plug connector slides into a recess of the socket connector and is securely guided and aligned with connection terminals during insertion. Complementary joining parts on the inside of the recess and the outer surface of the socket connector engage, prevent the socket connector from damaging the connection terminals in the recess, and securely guide the socket connector during insertion and reuse.

6 Claims, 6 Drawing Sheets

ELECTRICAL CONNECTOR

BACKGROUND TO THE INVENTION

1. Field of the Invention

The present invention relates to an electrical connector that has a plurality of connection terminals. More particularly, the present invention relates to an electrical connector with an improved alignment feature for employment in reliably connecting audio devices, such as car radios.

2. Description of the Related Art

Referring now to FIGS. 7 and 8, an electrical connector 1 includes a plug connector 3 mounted on a substrate 2, and a socket connector 4, which inserts into plug connector 3 to establish an electrical connection therebetween.

Plug connector 3 has a plug connector body 3*a* and a plurality of connection terminals 3*b* securely embedded in plug connector 3*a*.

Plug connector body 3*a* has a recess 3*c* which opens at an end surface thereof. Plug connector body 3*a* has a locking part 3*d* that protrudes downward from a lower surface of plug connector body 3*a*. Locking part 3*d* aids in positioning and temporarily retaining plug connector body 3*a* with respect to substrate 2.

Connection terminals 3*b* are arranged in two rows at a fixed interval in plug connector body 3*a*. One end of connection terminals 3*b* protrudes in a socket connector insertion direction inside recess 3*c* of plug connector body 3*a*. The other end of connection terminals 3*b* passes through plug connector body 3*a* and is exposed on the lower surface of plug connector body 3*a*. The other end of each connection terminal 3*b* is electrically connected by soldering to a connecting land (not shown) formed on the surface of substrate 2.

Referring now to FIGS. 9 through 12, socket connector 4 includes a socket connector body 4*a* and a plurality of connection terminals 4*b* embedded in socket connector body 4*a*.

Socket connector body 4*a* has a plurality of joining holes 4*c* which open on an end surface thereof allowing plug connection terminals 3*b* access to socket connection terminals 4*b*, during an assembly process.

Connection terminals 4*b* are arranged in two rows in the same manner as connection terminals 3*b* of socket connector 3. During careful assembly, socket connector body 4*a* of socket connector 4 is inserted inside recess 3*c* on plug connector body 3*a* of plug connector 3, one end of each connection terminal 3*b* fits inside each respective joining hole 4*c* of socket connector body 4*a*.

As a consequence of this contact between connection terminal 3*b* and connection terminal 4*b* of socket connector 4, an electrical connection is achieved linking socket connector 4 to substrate 2.

During normal assembly and use, after mounting plug connector 3 onto substrate 2, socket connector body 4*a* of socket connector 4 is inserted inside recess 3*c* of plug connector 3.

Once socket connector body 4*a* is completely pushed inside recess 3*c*, each connection terminal 3*b* of plug connector 3 contacts each of the corresponding connection terminal 4*b* of socket connector 4, and connection of socket connector 4 and plug connector 3 is achieved.

As can be seen from this design, during proper insertion, the outer surface of socket connector body 4*a* is restricted in the direction perpendicular to the insertion direction by the inner wall of recess 3*c* of plug connector body 3*a*.

Unfortunately, as shown by the tilted position A of socket connector body 4*a* in FIG. 7, when socket connector body 4*a* is inserted at a mis-aligned angle in the vertical direction with respect to recess 3*c* of plug connector 3, a lower end edge of socket connector body 4*a* contacts the end of connection terminals 3*b* of plug connector 3.

As a consequence, should socket connector body 4*a* be further inserted in an effort to achieve electrical connection, connection terminals 3*b* of plug connector 3 are bent, deformed, and may be broken. Resulting in undesirable equipment damage and expensive and costly repairs.

OBJECT AND SUMMARY OF THE INVENTION

It is an object of the present invention to provide an electrical connector in which straight and non-damaging insertion is ensured by simple construction.

The present invention relates to an electrical connector having a socket connector engagable with a plug connector. The plug connector slides into a recess of the socket connector and is securely guided and aligned with connection terminals during insertion. Complementary joining parts on the inside of the recess and the outer surface of the socket connector engage, prevent the socket connector from damaging the connection terminals in the recess, and securely guide the socket connector during insertion and reuse.

According to an embodiment of the present invention, there is provided an electrical connector, comprising: a socket connector, a socket connector body and a plurality of socket connection terminals in the socket connector, the socket connector body including a plurality of joining holes, the joining holes communicating respectively between first ends of each the socket connection terminal and a first face of the socket connector body, at least a first joining part on a first outer wall surface of the socket connector body, at least a second joining part on a second outer wall surface of the socket connector body, a plug connector, a plug connector body and a plurality of plug connection terminals in the plug connector, the plug connector body including a recess on a back end of the plug connector body, second ends of each the plug connection terminals extending into the recess toward the back end, the second ends of each the plug connection terminal insertably aligned with respective the joining holes and the socket connection terminals, at least a third joining part on a first inner wall surface of the recess, at least a fourth joining part on a second inner wall surface of the recess, and the first and second joining parts positively engaging, and preventing a misalignment of the socket connector with the plug connector, by aligning with respective the third and fourth joining parts during an insertion of the socket connector body into the recess, thereby preventing damage to the plug connection terminals and enabling easy electrical connection between the plug connection terminals and respective the socket connection terminals.

According to another embodiment of the present invention, there is provided an electrical connector, wherein: the at least first and second joining parts on the socket connector body are first and second guide ribs, and the at least third and fourth joining parts on the plug connector body are at least third and fourth guide grooves, whereby the guide ribs positively engages and slides along the guide grooves during the insertion and prevents the misalignment.

According to another embodiment of the present invention, there is provided an electrical connector, wherein: the at least first and second joining parts on the socket connector body are first and second guide grooves, and the at least third and fourth joining parts on the plug connector body are at least third and fourth guide ribs, whereby the guide grooves positively engages and slides along the guide ribs during the insertion and prevents the misalignment.

According to another embodiment of the present invention, there is provided an electrical connector, wherein: the at least first and second joining parts are at least one of a guide groove and a guiding rib, and the at least third and fourth joining parts are the other of the at least one of guide groove and the guide rib, whereby the at least one positively engages respective the other during the insertion and prevents the misalignment.

According to another embodiment of the present invention, there is provided an electrical connector, wherein: the guide grooves extend parallel to the plug connection terminals, the guide ribs extend parallel to the plug connection terminals, the guide grooves aligned with at least one of the plug connection terminals, and the guide ribs aligned with at least one of the plug connection terminals, whereby the joining parts maximize an insertion force during the insertion along the plug connection terminals and ensure a secure joining.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Figure 1:
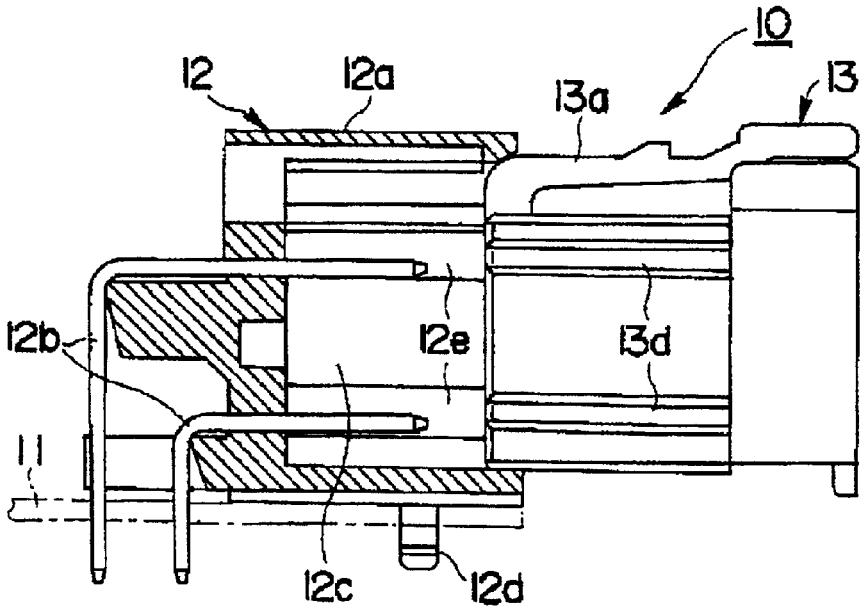
FIG. 1 is a partial cross-section showing the structure of an embodiment of an electrical connector.
Figure 2:
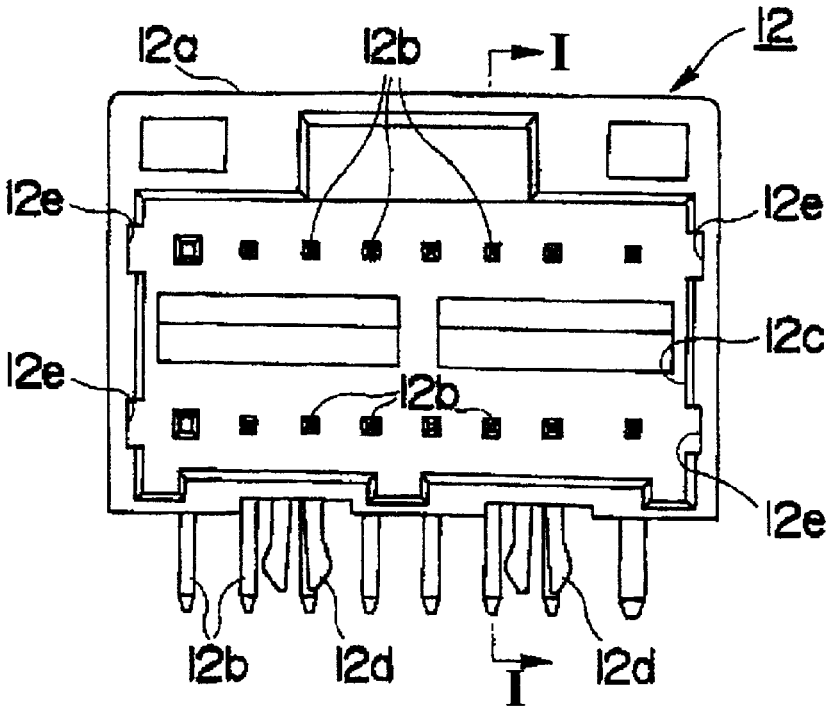
FIG. 2 is a front view of a plug connector of FIG. 1.
Figure 3:
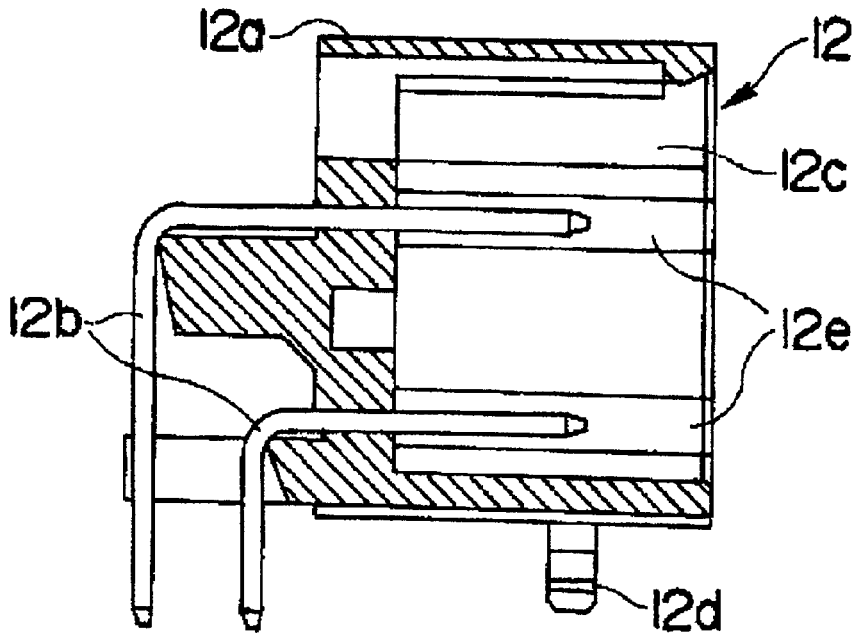
FIG. 3 is a cross-section taken along line I—I of the plug connector of FIG. 2.
Figure 4:
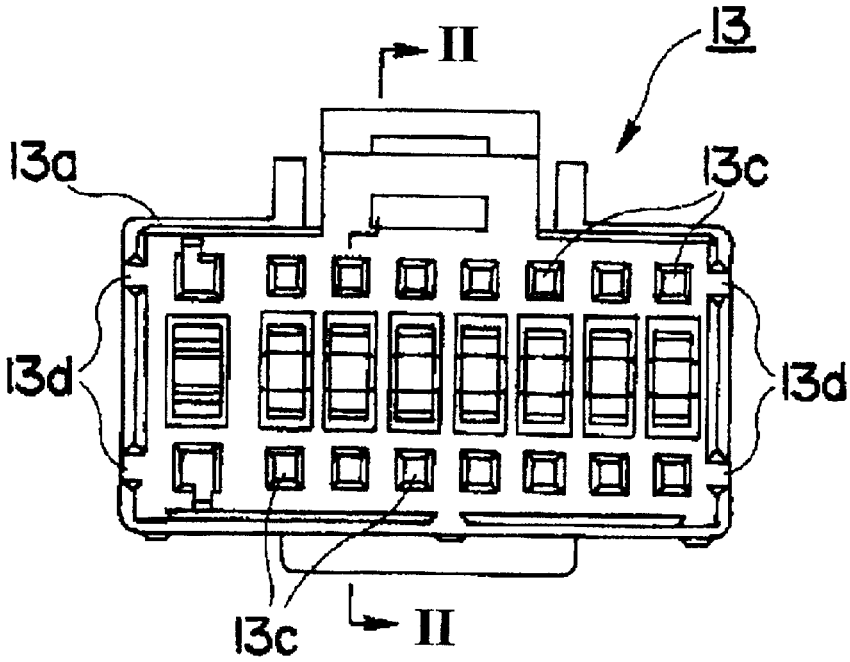
FIG. 4 is a front view of a socket connector FIG. 1.
Figure 5:
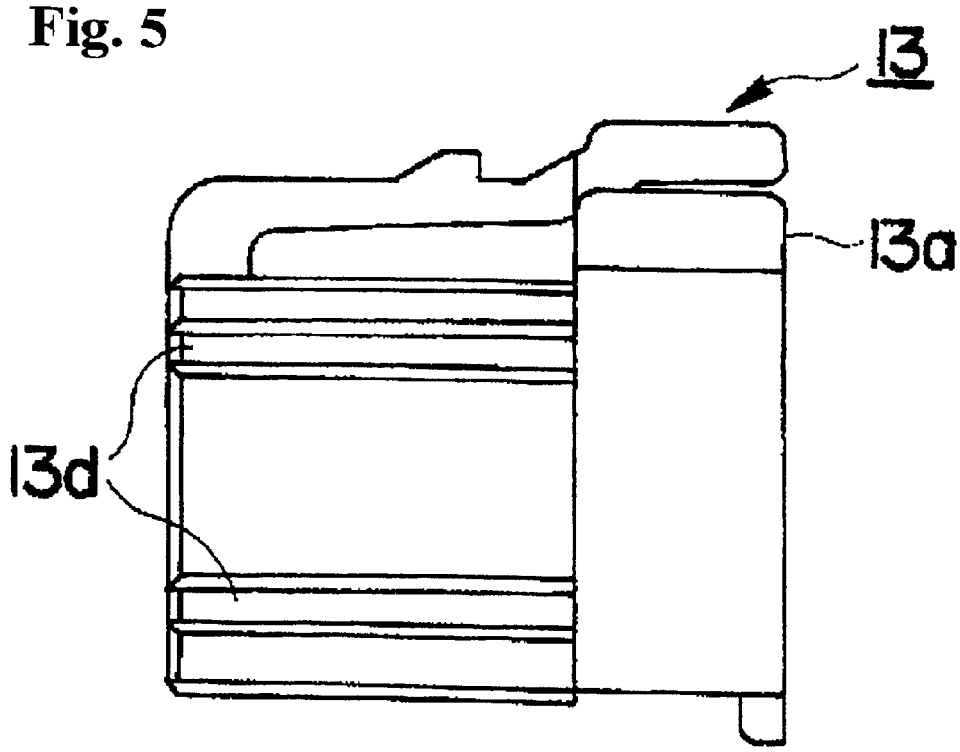
FIG. 5 is a side view of the socket connector of FIG. 4.
Figure 6:
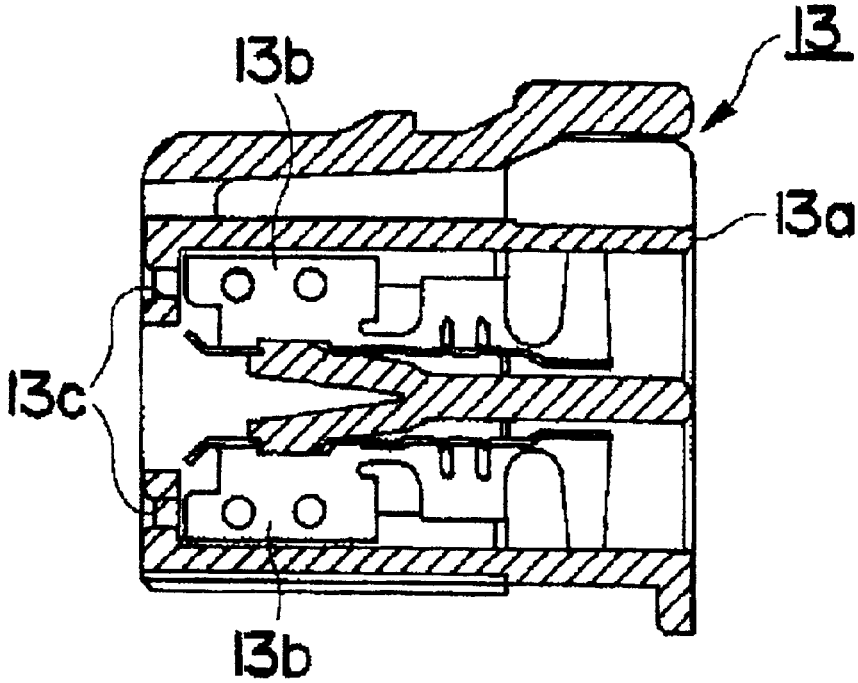
FIG. 6 is a cross-section taken along line II—II of the socket connector of FIG. 4.
Figure 7:
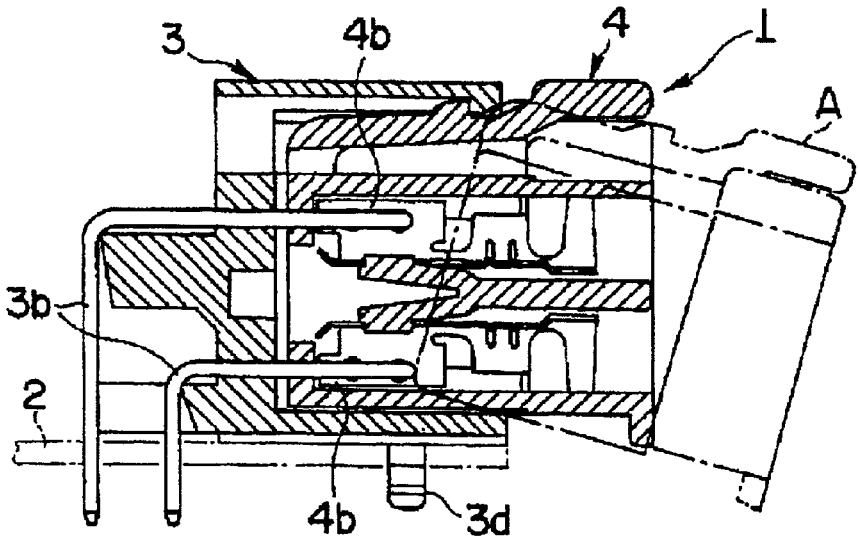
Fig. 7 Prior Art
FIG. 7 is a cross-section of one embodiment of an electrical connector of the related art.
Figure 8:
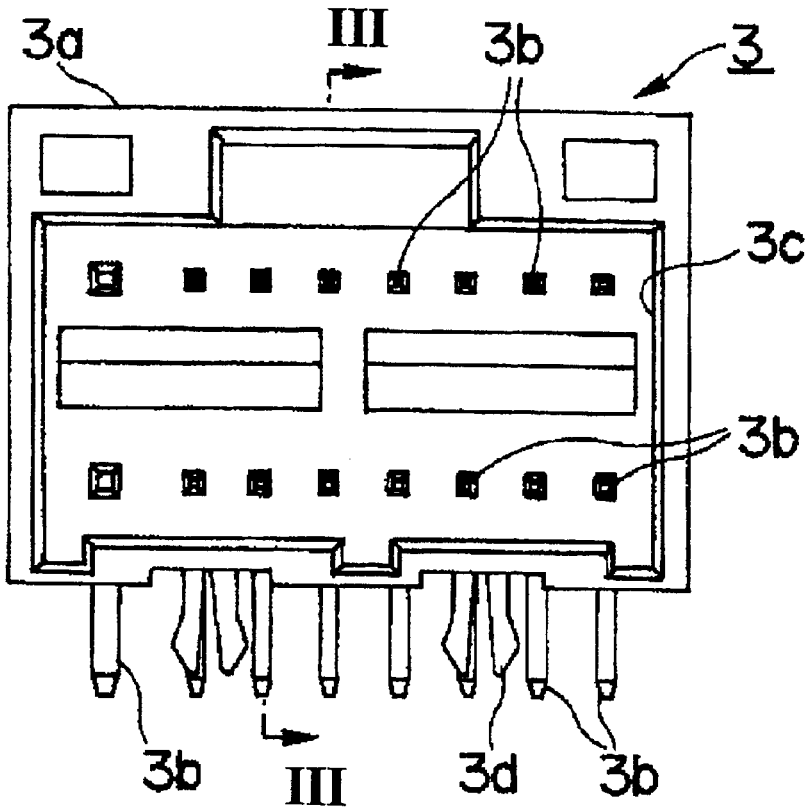
Fig. 8 Prior Art
FIG. 8 is a front view of a plug connector of FIG. 7.
Figure 9:
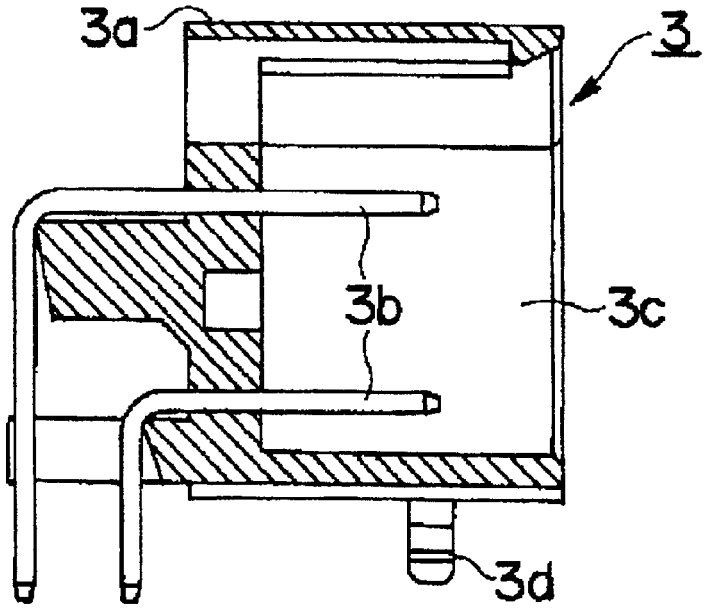
Fig. 9 Prior Art
FIG. 9 is a cross-section taken along line III—III of the plug connector of FIG. 8.
Figure 10:
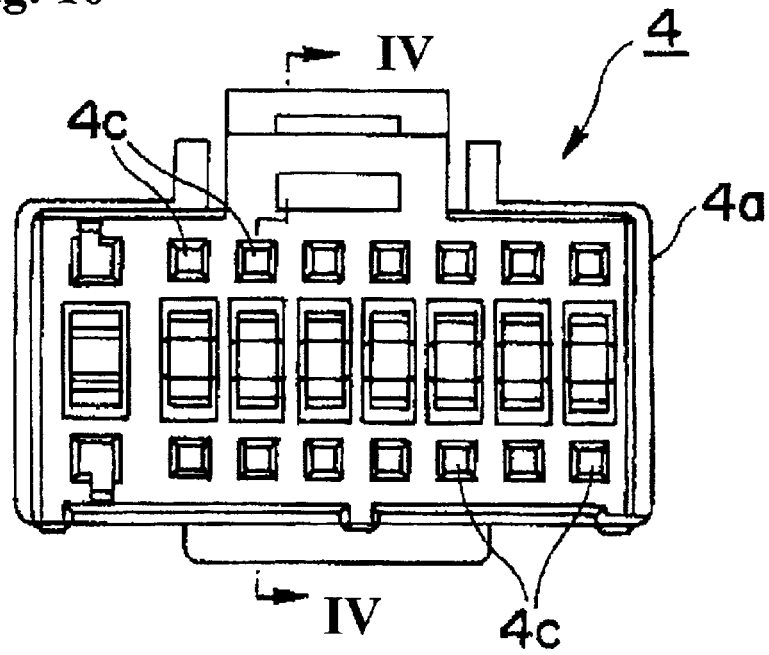
Fig. 10 Prior Art
FIG. 10 is a front view of a socket connector of FIG. 7.
Figure 11:
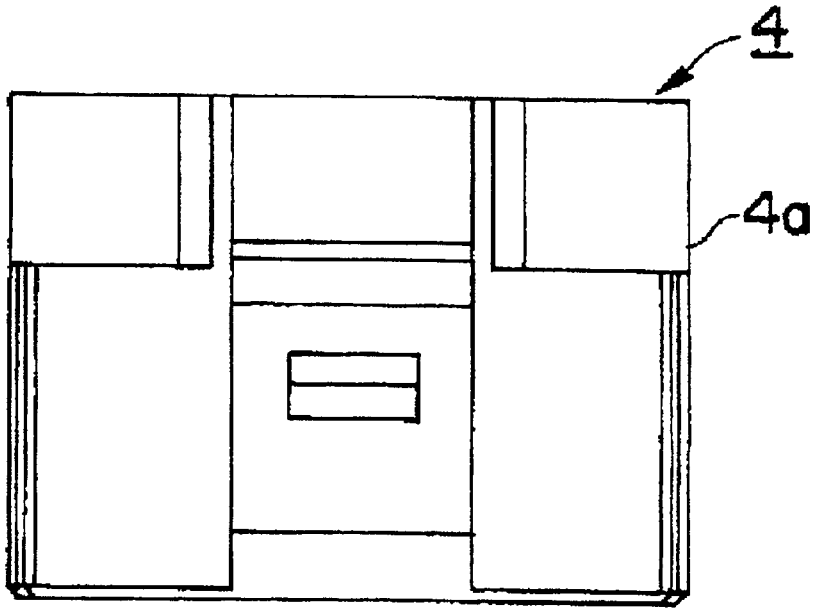
Fig. 11 Prior Art
FIG. 11 is a side view of the socket connector of FIG. 10.
Figure 12:
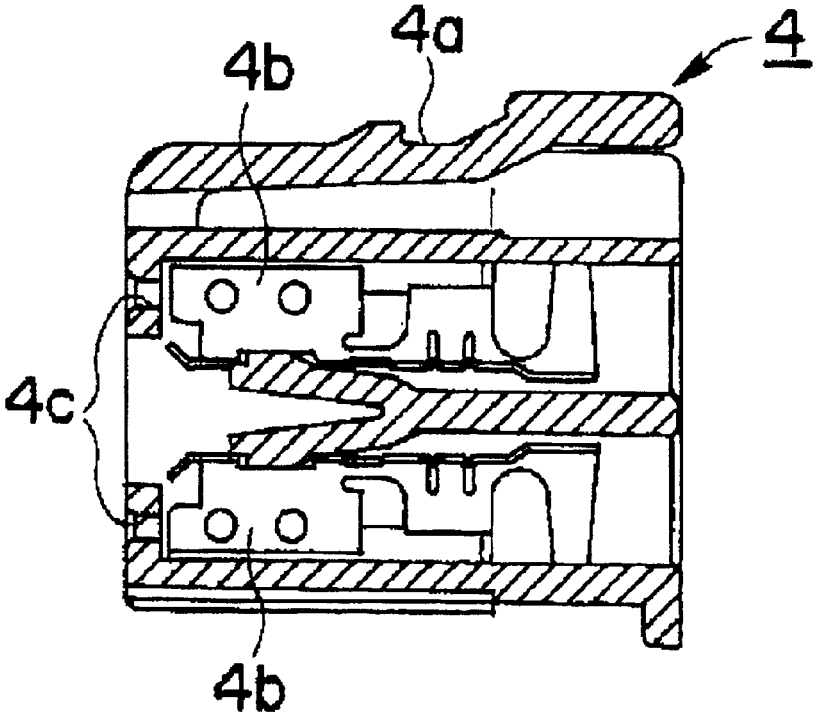
Fig. 12 Prior Art
FIG. 12 is a cross-section taken along line IV—IV of FIG. 10.

Referring to FIGS. 1 through 6, an electrical connector 10 includes a plug connector 12, mountable onto a substrate 11, and a socket connector 13 guidably insertable into plug connector 12, as will be explained.

A plug connector body 12*a* includes a plurality of connection terminals 12*b* securely embedded in plug connector body 12*a*.

A recess 12*c* in plug connector body 12*a* opens at an end surface for operable and guided receipt of socket connector 13 during use, as will be explained.

A locking part 12*d* extends away from plug connector body 12*a* and engages substrate 11, during assembly. Locking part 12*d*, operates to provide an operably secure attachment to substrate 11.

Connection terminals 12*b* are arrayed in plug connector body 12*a* in two rows. A first end of each connection terminal 12*b* protrudes inside recess 12*c* of plug connector body 12*a*, as shown. A second end of each connection terminal 12*b*, passes securely through plug connector body 12*a*, and extends away from a bottom surface of plug connector body 12*a* toward substrate 11.

During assembly, the second end of each connection terminal 12*b* extends to and electrically contacts with respective connection lands (not shown) formed on substrate 11. Each second end of respective connection terminals 12*b* is soldered to respective lands (not shown) and provides a secure electrical connection between plug connector 12 and substrate 11.

Socket connector body 13*a* has a plurality of connection terminals 13*b* which are embedded into socket connector body 13*a*.

Socket connector body 13*a* is equipped with a plurality of joining holes 13*c* which extend from an end surface of socket connector body 13*a* to an interior of said socket connector body 13 a and allow access by the first ends of connection terminals 12*b* to socket connector terminals 13*b*, as will be explained.

A connection terminal 13*b* are housed inside respective joining hole 13*c* of socket connector body 13*a*. In the present embodiment, connection terminals 13*b* are arranged in two rows positioned to engage respective connection terminals 12*b* of plug connector 12.

During assembly, when socket connector body 13*a* is inserted inside recess 12*c* on plug connector body 12*a*, one end of connection terminals 12*b* of socket connector body 12*a* extends inside each joining hole 13*c* of socket connector body 13*a* and contacts connection terminal 13*b* to provide electrical connection therethrough.

A plurality of guide grooves 12*e* are on opposite inside surfaces of recess 12*c* in plug connector body 12*a*. Guide grooves 12*e* are joining parts or joining means that extend along the insertion direction of socket connector 13.

A plurality of guide ribs 13*d* are on both outside surfaces of socket connector body 13*a*. Guide ribs 13*d* are also joining parts or joining means and extend along the insertion direction of socket connector 13 corresponding to guide grooves 12*e*.

As presently shown, there are two vertically separated guide grooves 12*e* and guide ribs 13*d* on each side of respective plug connector body 12*a* and socket connector body 13*a*.

In the embodiment shown, positions and heights of guide grooves 12*e* and guide ribs 13*d* correspond to the heights of the two rows of connection terminals 12*b* and connection terminals 13*b* of socket connector 13.

Guide grooves 12*e* receive and positively engage guide ribs 13*d* and mandate alignment of socket connector body 13*a* with plug connector body 12*a* during an insertion into recess 12*c*.

At the beginning of the insertion process, before possible damage to the ends of connection terminals 12*b*, guide ribs 13*d* initially engage and slide into respective guide grooves 12*e*. Since there are two vertically aligned sets of guide grooves/guide ribs, vertical and horizontal misalignment of socket connector body 13*a* relative to plug connector body 12*a*, is prevented. Since vertical and horizontal misalignment is prevented, damage to connection terminals 12*b* is correspondingly prevented, even during repeated insertion and disengagement actions.

During a middle of the insertion process, guide ribs 13*d* engage guide grooves 12*e* and align and guide initial engagement between joining holes 13*c* and respective connection terminals 12*b*. At this time ends of connection terminals 12*b* initially enter joining holes 13*c* and do not, as yet, contact connection terminals 13*b*.

During the end of the insertion process the ends of connection terminals 12*b* positively engage respective connection terminals 13*b* in an alignment matter and provide electrical connection therethrough.

As a benefit of the present embodiment, even where socket connector 13 is initially pushed into recess 12*c* at an angle with respect to plug connector 12, guide ribs 13*d* and guide grooves 12*e* reposition and straighten the insertion direction and prevent damage to connection terminals 12*b*.

As an additional benefit, since guide grooves 12*e* and guide ribs 13*d* are provided at the same height as connection terminals 13*b* and connection terminals 12*b*, connection terminals 13*b* of the socket connector and connection terminals 12*b* of the plug connector are connected smoothly as alignment force beneficially operates along the direction of positive engagement.

As a consequence of the present invention, socket connector 13 is never inserted into plug connector 12 at an angle and there is no danger of connection terminals 12*b* being bent, deformed, or broken by the end edge of socket connector body 13*a*. As a result, a highly reliable electrical connector 10 is achieved for a manufacturer and user of the present invention.

With the above-described embodiment, socket connector 13 has guide ribs 13*d* and plug connector 12 has guide grooves 12*e* as respective joining parts for the socket connector and plug connector. However, it should be understood, that the present invention is not limited to the above-described embodiment, and in a reverse embodiment, socket connector 13 could have guide grooves, and plug connector 12 could have the guide ribs. The joining parts could have other suitable shapes which mutually engage and maintain alignment between the parts involved.

Connection terminals 12*b* protrude downward from the lower surface of plug connector body 12*a*, but may alternatively protrude from another surface of plug connector 12*a*, where a substrate 11 would be alternatively, or additionally attached.

As described above, according to the present invention, when a socket connector is connected with a plug connector, a joining part that is provided on the outer surface of a socket connector body and is preferably a guide rib or a guide groove which joins with a joining part that is provided on the inner surface of a recess of the plug connector body and is preferably a respective guide groove or a guide rib. The design of the present embodiment of the socket connector is guided straight in the insertion direction with respect to the plug connector.

When the joining part on the socket connector is guided by the joining part of the plug connector, the socket connector is not at an angle with respect to the plug connector, and they are guided together in a straight manner. As a result, the socket connector body does not contact the connection terminals and bending deformation or breaking resulting from the slanted insertion does not occur. Consequently, a reliability of the electrical connector is improved with a construction which is simple and is cost effective to produce.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the specification above or claims below, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector, comprising:

a socket connector;

a socket connector body and a plurality of socket connection terminals in said socket connector;

said socket connector body including a plurality of joining holes;

said joining holes communicating respectively between first ends of each said socket connection terminal and a first face of said socket connector body;

at least a first joining part on a first outer wall surface of said socket connector body and vertically aligned with said plurality of socket connection terminals;

at least a second joining part on a second outer wall surface of said socket connector body and vertically aligned with said plurality of socket connection terminals;

a plug connector;

a plug connector body and a plurality of plug connection terminals in said plug connector;

said plug connector body including a recess on a back end of said plug connector body;

second ends of each said plug connector terminals extending into said recess toward said back end;

said second ends of each said plug connection terminal insertably aligned with respective said joining holes and said socket connection terminals;

at least a third joining part on a first inner wall surface of said recess and vertically aligned with said plurality of plug connection terminals;

at least a fourth joining part on a second inner wall surface of said recess and vertically aligned with said plurality of plug connection terminals; and said first and second joining parts positively engaging, and preventing a misalignment of said socket connector with said plug connector, by aligning with respective said third and fourth joining parts during an insertion of said socket connector body into said recess prior to engagement between said plug connection terminals and respective socket connection terminals, thereby preventing damage to said plug connection terminals and enabling easy electrical connection between said plug connection terminals and respective said socket connection terminals.

2. An electrical connector, according to claim 1, wherein:

said at least first and second joining parts on said socket connector body are first and second guide ribs; and said at least third and fourth joining parts on said plug connector body are at least third and fourth guide grooves, whereby said guide ribs positively engages and slides along said guide grooves during said insertion and prevents said misalignment.

3. An electrical connector, according to claim 1, wherein:

said at least first and second joining parts on said socket connector body are first and second guide grooves; and said at least third and fourth joining parts on said plug connector body are at least third and fourth guide ribs, whereby said guide grooves positively engages and slides along said guide ribs during said insertion and prevents said misalignment.

4. An electrical connector, according to claim 1, wherein:

said at least first and second joining parts are at least one of a guide groove and a guiding rib; and said at least third and fourth joining parts are the other of said at least one of guide groove and said guide rib, whereby said at least one positively engages respective said other during said insertion and prevents said misalignment.

5. An electrical connector, according to claim 4, wherein:

said guide grooves extend parallel to said plug connection terminals, said guide ribs extend parallel to said plug connection terminals, said guide grooves aligned with at least one of said plug connection terminals; and said guide ribs aligned with at least one of said plug connection terminals, whereby said joining parts maximize an insertion force during said insertion along said plug connection terminal and ensure a secure joining.

6. An electrical connector, comprising:

a socket connector comprising:

a plurality of socket connection terminals in said socket connector;

a first outer wall disposed vertically;

a second outer wall disposed vertically and opposite said first outer wall;

at least one of a first guide rib and a first guide groove, on said first outer wall; and at least one of a second guide rib and a second guide groove, on said second outer wall, wherein said at least one of first and second guide ribs and guide grooves extend parallel to said socket connection terminals;

a plug connector comprising:

a plurality of plug connection terminals in said plug connector;

a back end;

a recess on the back end;

a first inner wall disposed vertically;

a second inner wall disposed vertically and opposite said first inner wall;

at least one of a third guide rib and a third guide groove, on said first inner wall corresponding to the opposite of said first guide rib and first guide groove;

at least one of a fourth guide rib and a fourth guide groove, on said second inner wall corresponding to the opposite of said second guide rib and second guide groove, wherein said third and fourth guide ribs and guide grooves, extend parallel to said plug connection terminals; and said first and second guide ribs, and alternatively guide grooves, are operable to positively engage, and prevent a misalignment of said socket connector with said plug connector, by aligning with respective said third and fourth guide ribs and guide grooves, during an insertion of said socket connector body into said recess prior to engagement between said plug connection terminals and respective socket connection terminals.

* * * * *